US006547220B2

(12) United States Patent
Johnson

(10) Patent No.: US 6,547,220 B2
(45) Date of Patent: Apr. 15, 2003

(54) OPEN LOOP CONTROL WITH VELOCITY THRESHOLD FOR PNEUMATIC HOIST

(75) Inventor: Douglas A. Johnson, Groveland, MA (US)

(73) Assignee: Wilmington Research and Development Corporation, Newburyport, MA (US)

( * ) Notice: Subject to any disclaimer, the term of this patent is extended or adjusted under 35 U.S.C. 154(b) by 129 days.

(21) Appl. No.: 09/773,276

(22) Filed: Jan. 31, 2001

(65) Prior Publication Data

US 2001/0045549 A1 Nov. 29, 2001

Related U.S. Application Data

(60) Provisional application No. 60/179,268, filed on Jan. 31, 2000.

(51) Int. Cl.[7] ..... B66D 1/44
(52) U.S. Cl. ..... 254/331; 254/268; 254/360
(58) Field of Search ..... 254/268, 274, 254/275, 276, 331, 360

(56) References Cited

U.S. PATENT DOCUMENTS

| | | | | | |
|---|---|---|---|---|---|
| 3,758,079 | A | * | 9/1973 | Workman et al. | 254/360 |
| 3,933,080 | A | * | 1/1976 | Corrie | 91/26 |
| 4,044,651 | A | | 8/1977 | Warrick | 91/47 |
| 4,372,534 | A | | 2/1983 | Hansson | 254/269 |
| 5,439,200 | A | | 8/1995 | Braesch et al. | 254/267 |
| 5,915,673 | A | * | 6/1999 | Kazerooni | 212/285 |

FOREIGN PATENT DOCUMENTS

| | | |
|---|---|---|
| DE | 19727194 A1 | 1/1999 |
| FR | 2 738 808 | 3/1997 |
| SU | 1379246 A2 | 3/1988 |
| SU | 1682639 A1 | 10/1991 |
| WO | WO 95/19316 | 7/1995 |

* cited by examiner

*Primary Examiner*—Kathy Matecki
*Assistant Examiner*—Evan Langdon
(74) *Attorney, Agent, or Firm*—Hamilton, Brook, Smith & Reynolds, P.C.

(57) ABSTRACT

A control system for a pneumatic hoist limits the velocity or acceleration of a load attached to the hoist. The control system includes a controller and a valve. The controller provides a variable gain between an actuator, which controls the speed of the hoist, and the valve, which controls fluid flow into the hoist, thereby controlling the velocity or acceleration of the load. As the velocity or the acceleration of the load reaches a predetermined maximum value, the control system proportionally reduces the gain between the actuator and the valve, thereby closing the valve and reducing the velocity or acceleration of the hoist.

16 Claims, 6 Drawing Sheets

| ACTUAL VELOCITY \ ACTUAL ACCELERATION | 0 | 0.2 | 0.4 | 0.6 | 0.8 | 1 |
|---|---|---|---|---|---|---|
| 1 | 0 | 0 | 0 | 0 | 0 | 0 |
| 0.8 | 0.16 | 0.12 | 0.08 | 0.4 | 0 | |
| 0.6 | 0.32 | 0.24 | 0.16 | 0.08 | 0 | |
| 0.4 | 0.48 | 0.36 | 0.24 | 0.12 | 0 | |
| 0.2 | 0.64 | 0.48 | 0.32 | 0.16 | 0 | |

FIG. 2A

| ACTUAL VELOCITY \ ACTUAL ACCELERATION | 0 | 0.2 | 0.4 | 0.6 | 0.8 | 1 |
|---|---|---|---|---|---|---|
| 1 | 0 | 0 | 0 | 0 | 0 | 0 |
| 0.8 | 0.4 | 0.34 | 0.28 | 0.2 | 0 | |
| 0.6 | 0.56 | 0.49 | 0.4 | 0.28 | 0 | |
| 0.4 | 0.69 | 0.6 | 0.49 | 0.34 | 0 | |
| 0.2 | 0.8 | 0.69 | 0.56 | 0.4 | 0 | |

FIG. 2B

| MAXIMUM ALLOWED VELOCITY | MAXIMUM ALLOWED ACCELERATION | | | | | | | | |
|---|---|---|---|---|---|---|---|---|---|
| | 4 | 8 | 12 | 16 | 20 | 24 | 28 | 32 | 36 |
| 50 | 328 | 164 | 109 | 82 | 66 | 55 | 47 | 41 | 36 |
| 75 | 218 | 109 | 73 | 55 | 44 | 36 | 31 | 27 | 24 |
| 100 | 164 | 82 | 55 | 41 | 33 | 27 | 23 | 20 | 18 |
| 125 | 131 | 66 | 44 | 33 | 26 | 22 | 19 | 16 | 15 |
| 150 | 109 | 55 | 36 | 27 | 22 | 18 | 16 | 14 | 12 |
| 175 | 94 | 47 | 31 | 23 | 19 | 16 | 13 | 12 | 10 |
| 200 | 82 | 41 | 27 | 20 | 16 | 14 | 12 | 10 | 9 |
| 225 | 73 | 36 | 24 | 18 | 15 | 12 | 10 | 9_ | 8 |
| 250 | 66 | 33 | 22 | 16 | 13 | 11 | 9 | 8 | 7 |

FIG. 4

OPEN LOOP CONTROL WITH VELOCITY THRESHOLD FOR PNEUMATIC HOIST

RELATED APPLICATION(S)

This application claims the benefit of U.S. Provisional Application No. 60/179,268, filed on Jan. 31, 2000.

The entire teachings of the above application(s) are incorporated herein by reference.

BACKGROUND OF THE INVENTION

Pneumatic balancers are in widespread use in the material handling industry. The balancers are formed of a large air cylinder that rotates about a fixed axis, reeling a wire rope in or out as the cylinder is pressurized with air. There are several advantages to this type of pneumatic lifting device. One advantage is that once a heavy load has been lifted, the load "floats" or is "balanced" by the air that is pressurized inside the cylinder. This lets the user maneuver the heavy load up or down a short distance, while the load is positioned and secured onto an assembly. The combination of heavy lifting capacity and load suspension or "balancing" makes pneumatic balancers useful.

One of the drawbacks with pneumatic balancers involves controlling the speed of pressurization of the cylinder. If the cylinder is pressurized at a relatively slow rate, the load is lifted at a slow rate which slows down the operator. If the cylinder is pressurized at a relatively high rate, a smaller or lighter load can be violently "launched" across the room.

A traditional, all mechanical, solution to this problem is to use thumb screw adjustable needle valves to set the rate at which the cylinder pressurizes, and to employ a mechanical (centrifugal) brake which grabs and stops the cylinder if the velocity of the wire rope is too high. This solution, however, has drawbacks. The needle valves must be set based on the weight of the load being lifted. If the needle valves are set to lift a very heavy load by a first user, and at a later point a second user operates the balancer to lift a very light load without adjusting the needle valves, operation of the balancer causes the wire rope to accelerate much too quickly. At some later point, the mechanical brake "grabs" the cylinder, stopping it instantly. This violent series of events can still "launch" the light load, and in any case, is unsettling to the unexpecting user.

Another solution to this problem involves the use of an electronic control system to control the rate at which the load is lifted. The control system requires a device to measure the speed of the wire rope, a valve which controls the speed of air entering the cylinder, and a device which allows the user to set the rate at which the load is being lifted. A drawback to the use of the electronic control system involves requiring the control system to exhibit a desirable response to a user's speed request inputs over a full range of loads.

Classical control system theory assumes the use of a setpoint variable, which is, for example, a user's joystick setting that represents the desired velocity of the wire rope, and a process variable, which is the actual velocity of the wire rope. The difference between the set point variable and the process variable is the process error. The process error is then differentiated and integrated with respect to time. These three representations of the error are then scaled with three empirically determined constants, and the resulting three products are summed, generating an output which is used as the driving function for the process. These three parts of the driving function are referred to as Proportional, Integral and Differential (PID). This entire function, which occurs in real time, feeds back process variable information into the function such that the process error is driven to zero. This type of control is referred to as a closed loop control.

One issue in using a PID control with a balancer is that the "empirically determined constants" (or PID settings) are nominally set using a nominal weight on the balancer. This concept does not insure desirable performance over the full range of expected loads. Another complication is that the pressurized air, which is lifting the load, acts like a large spring (i.e. the air is compressible) where the spring constant changes depending on the weight being lifted (pressure in the cylinder).

SUMMARY OF THE INVENTION

A preferred embodiment of the present invention relates to a hoist whereby the lifting or lowering velocity of the hoist is independent of the load attached to the hoist.

More specifically, a velocity and acceleration limiter has been implemented within a hoist to decouple velocity and the effect of the load.

The user's force sensitive inputs can control the pneumatic valve directly, i.e. with a fixed gain) as long as the wire rope's velocity and acceleration are below pre-determined maximum values. If either the velocity or acceleration approaches the maximum value, the gain between the user's inputs and the pneumatic valve is automatically reduced using a gain control or gain reduction algorithm, thus opening the pneumatic valve less and reducing the velocity or acceleration of the hoist.

In order to cause the control system to exhibit a desired response to a user's speed request, the velocity and/or acceleration of the wire rope of a hoist is limited, rather than controlled, by the gain control algorithm. The user controls the velocity of the hoist in an open loop fashion. One benefit of the velocity limiting function is that as long as the user maintains the velocity below the maximum allowed, the output of the speed setting joystick is essentially connected directly to the input of the spool valve, with minimal effect of the gain control algorithm between the joystick and the hoist. This provides a direct feel for the user when moving a load at a slow rate of speed. A second benefit is that a velocity limiting function is not a closed loop function. There is no "setpoint variable" and there is no "process error" that is driven to zero, which are fundamentally part of a closed loop system.

In one embodiment, the hoist includes a housing having a first end wall and a second end wall, the housing, first end wall and second end wall forming a chamber. An inlet mechanism is attached to the housing the inlet mechanism and allows the passage of a fluid, such as air, into the chamber. The hoist includes a piston mounted within the chamber and a valve connected to the inlet mechanism. The valve controls the amount of fluid entering the chamber. The hoist also includes a pressure sensor attached to the chamber and a position measuring device connected to the housing. The pressure sensor is in fluid communication with a fluid within the chamber and the position measuring device is in positional communication with the piston. Also included is an actuator in electrical communication with the valve, the actuator controlling the positioning of the valve, and a control system in electrical communication with the valve, the pressure sensor, the position measuring device and the actuator. The control system has a variable gain between the actuator and the valve, where the gain is reduced as the velocity or acceleration of a load attached to the piston approaches a preset maximum value.

The variable gain of the control system includes a gain reduction algorithm. This gain reduction algorithm preferably includes a square root function.

The actuator has a plurality actuator control inputs. Engagement of an actuator control input pulses the valve in a first direction. The actuator also includes a deadband value. Engagement of the deadband value after engagement of an actuator control input pulses the valve in a second direction, opposite to the first direction, which stops the motion of the piston. Preferably, the control system includes a pulse magnitude algorithm that scales a moving average of a valve magnitude upon engagement of the deadband value, based upon first direction of the valve.

The hoist can also include a load selector that adjusts a maximum allowed velocity value and a maximum allowed acceleration value of the hoist with respect to a load attached to the hoist. The control system of the hoist can also include a closed loop control system. The closed loop control system can include a position control or a pressure control.

An embodiment of the present invention also relates to a method for adjusting the velocity of a load attached to a pneumatic hoist. Another embodiment of the invention also relates to a method for stopping the motion of a load attached to a hoist

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIGS. 2A and 2B show gain results of the control system based on a non-square root and a square root function, respectively.

FIG. 4 shows a gain calculation table for the gain of the control system.

DETAILED DESCRIPTION OF THE INVENTION

Figure 1:
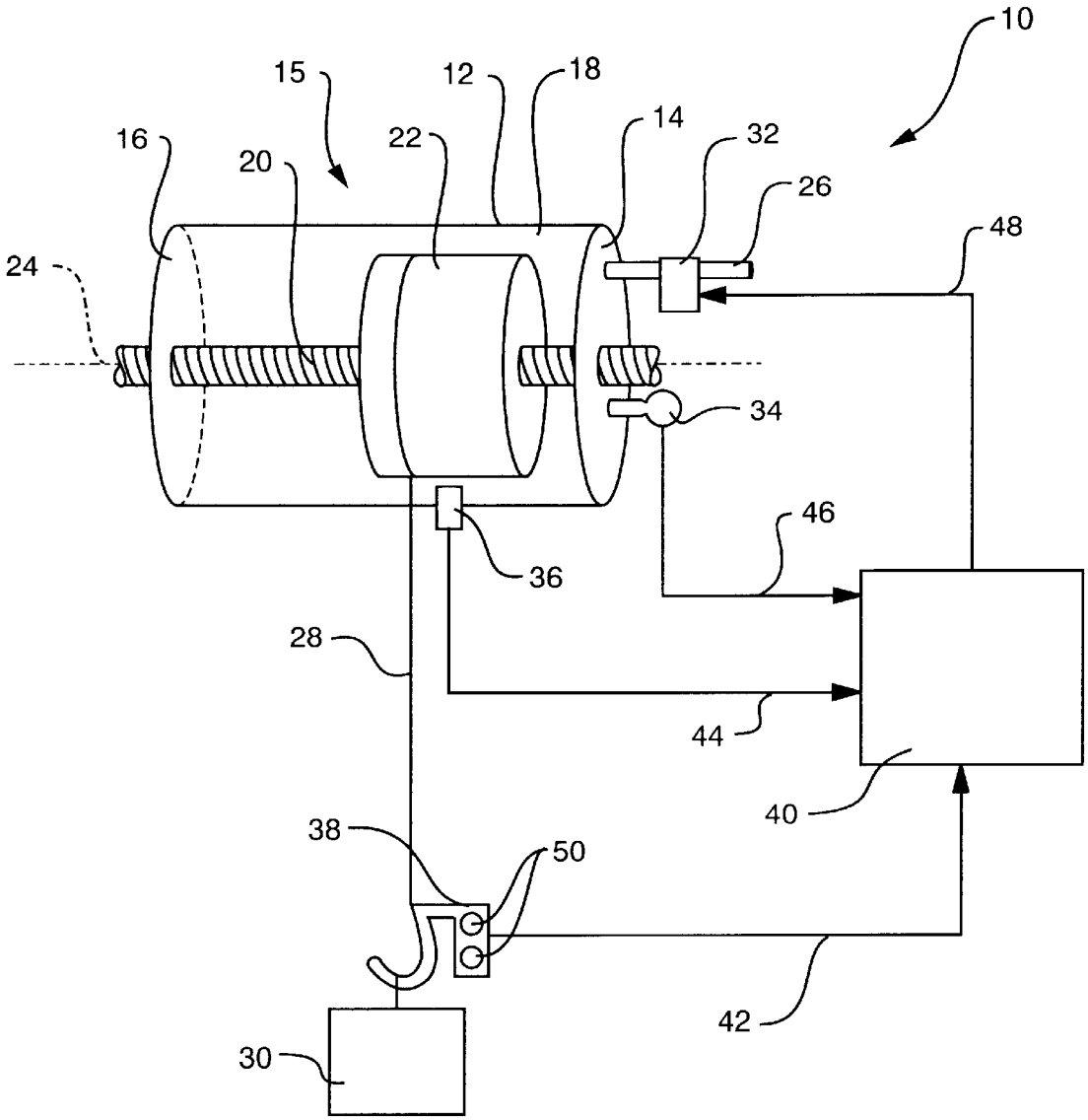
FIG. 1 shows a control system for a pneumatic hoist.

FIG. 1 illustrates a control system for a pneumatic hoist, given generally as 10. The control system 10 includes a hoist 15 having a housing 12. The housing 12 includes a first end wall 14 and a second end wall 16 and forms a hollow chamber 18. The housing 12 also includes a lead screw 20 and a piston 22. The lead screw 20 is mounted along a longitudinal axis 24 of the housing. The piston 22 is slidably mounted to the lead screw 20. The housing 12 includes an inlet mechanism 26 which allows the flow of a fluid into the chamber 18. Preferably, the fluid is a pressurized gas such as air, for example. The entrance of fluid into the chamber 18 causes rotational movement of the piston 22 on the lead screw 20 about the longitudinal axis 24. The faster the fluid from the inlet 26 enters the chamber 18, the greater the rotational velocity or acceleration of the piston 22.

The piston 22 includes a cable 28 attached to and wrapped around an outer circumference of the piston 22. The cable 28 can be made from a wire material, such as a wire rope. The cable 28 connects the piston 22 to a load 30 and allows for raising and lowering of the load 30 by the hoist 15. An actuator 38 is attached to the cable 28 and controls the rotational velocity and acceleration of the piston 22 and controls the movement and positioning of the cable 28. The actuator 38 includes actuator controls that are force sensitive such that the greater the amount of force a user exerts as the actuator controls 50, the faster the load 30 moves in either an upward or downward direction. The force sensitive controls can be load cells, for example and the actuator can include ajoystick.

The control system 10 also includes a position measuring device 36, a pressure sensor 34 and a valve 32 attached to the inlet mechanism 26. The position measuring device 36 is attached to the housing 12 and can be in communication with either the cable 28 or the piston 22. The position measuring device 36 measures the position of the piston 22 or cable 28 and determines the distance that either the cable 28 or the piston 22 has traveled from some starting position. The pressure sensor 34 is also attached to the housing 12 and is in fluid communications with the fluid located within the chamber 18 of the housing 12. The pressure sensor 34 measures the pressure of the fluid inside the chamber 18. The valve 32 attached to the inlet 26 controls the amount of fluid entering the chamber 18 through the inlet 26. Regulation of the amount of fluid entering the chamber 18, in turn, controls the rotational velocity and acceleration of the piston 22. The valve 32 can be a pneumatic valve, for example.

The control system 10 also includes a controller 40. The controller 40 receives data from the actuator 38, position measuring device 36 and pressure sensor 34 by an actuator data line 42, a position device data line 44 and a pressure sensor data line 46, respectively. Based upon this data, the controller 40 can control the closure of the valve 32 by way of a valve data line 48. Certain parameters of data can cause the valve 32 to be fully opened by the controller 40 or fully closed. The control system 40 can include a computer, for example.

The controller 40 allows the velocity of the piston 22 and the cable 28 to be independent from the mass or weight of the load 30. The controller 40 stores a predetermined maximum value for the velocity and acceleration of the cable 28. The controller 40 also stores a predetermined value for gain which is implemented between the actuator 38 and the valve 32.

When an operator uses the hoist 15, he engages the actuator 38 to move the load 30 in either an upward or downward direction. As the user moves the load 30, the position measuring device 36 measures the distance the cable 28 has traveled over some period of time. From this measurement, the velocity or acceleration of both the cable 28 and the load 30 can be calculated. The controller 40 compares the calculated velocity or acceleration of the cable 28 to the predetermined maximum allowed value of velocity or acceleration of the hoist 15. If the calculated velocity or acceleration of the cable 28 is less than the predetermined maximum value, the controller 40 makes minimal changes to the gain of the system, thereby allowing the direct control of the valve 32 by the actuator 38. By directly controlling the valve 32, the actuator 38 controls the velocity and acceleration of the piston 22, the cable 28 and the load 30. The user's direct control of the velocity or the acceleration of the piston 22, cable 28 and load 30 is an example of an open loop control system.

As the calculated velocity or acceleration of the cable 28 approaches the predetermined maximum value, the control system 40 proportionally reduces the gain between the actuator 38 and the valve 32. Reducing the gain reduces the valve 32 opening on the inlet mechanism 26, thereby preventing fluid from entering the chamber 18. This, in turn, reduces the velocity or acceleration of the piston 22, the cable 28 and the load 30. As long as the velocity and/or acceleration of the cable 28 is below the maximum allowed value, the user has direct control of valve, with minimal effect of the gain control algorithm. As the velocity and/or acceleration approaches the maximum allowed value, the gain is proportionally reduced, thus reducing the valve 32 opening and thus reducing the velocity of the load 30 and the cable 28. This reduction in velocity occurs even though the user has the joystick or actuator 38 engaged at a maximum level of operation.

There is a complication in implementing the gain control. Consider that the user moves the actuator until the velocity begins to approach a preset maximum value. The controller 40 then reduces the actuator gain, reducing the opening of the valve 32 orifice, and the velocity of the piston 22 is reduced. At this point the velocity is no longer near a preset maximum value, so the controller 40 restores the original gain, thereby opening the valve 32 to increase the velocity, thereby increasing the velocity of the piston to a level near the preset maximum value. Notice that this oscillation takes place with the user's actuator 38 at a constant setting. One solution to this problem is to use continuously updated peak velocity and peak acceleration measurements, rather than the actual velocity or acceleration values, when calculating the gain reduction. The addition of the peak function serves to give the measurements a static attribute that breaks the oscillatory operation described above. The length of time that the peak is held before being reset to zero is empirically determined, and allows new peaks to be captured and updated. Use of the updated peak velocity and acceleration are described as follows.

A user operates an actuator 38 or joystick to control the velocity or acceleration of the hoist 15. The joystick produces signed integers or joystick integer values representing the user's velocity request. The maximum "up" velocity request is +512 and the maximum down velocity request is −511. A value of 0 indicates the joystick 38 is at a center position that requests no movement.

As the actuator 38 is manipulated, valve data is sent to the valve 32 where the valve data comprises signed integers representing the magnitude and direction of spool valve excitation. The maximum valve opening in the "up" direction (pressurizing) is +128 and the maximum valve opening in the down direction (relieving pressure) is −127. A value of 0 indicates the valve is in center position has no opening in either direction.

Velocity and acceleration are calculated based on the position measuring device 36 or encoder which keeps track of the cable 28 position. The hoist 15 or balancer and encoder 36 combination provides approximately 6 feet of cable 28 extension with a resulting position count (from fully retracted to fully extended) of approximately 15,000 counts. The actual position count is always preset at power up to 30,000 counts in that the position of the cable 28 is always a positive integer. Actual position of the cable 28 or piston 22 is updated every 6.25 msec. Velocity of the cable 28 is a signed integer and is calculated every fourth position update (25 msec rate) using the formula: velocity=current position—position four updates ago. Acceleration of the cable 28 is a signed integer and is also calculated every fourth position update (25 msec rate) using the formula: acceleration current velocity−last velocity calculated.

The peak velocity and peak acceleration of the cable are also calculated. The held or stored peak velocity and peak acceleration values are reset at regular intervals. Preferably, the values are reset at an interval within the range of 75 ms and 150 ms.

Gain reduction for the purpose of velocity and acceleration limiting occurs when either the peak velocity or peak acceleration begins to approach maximum allowed settings. Ordinals 1–9 are used to represent the maximum allowed settings for the velocity and acceleration as follows:

maximum allowed velocity settings:

1=velocity of 50 counts is allowed
2=velocity of 75 counts is allowed
3=velocity of 100 counts is allowed
4=velocity of 125 counts is allowed
5=velocity of 150 counts is allowed
6=velocity of 175 counts is allowed
7=velocity of 200 counts is allowed
8=velocity of 225 counts is allowed
9=velocity of 250 counts is allowed maximum allowed acceleration settings:

1=acceleration of 4 counts is allowed
2=acceleration of 8 counts is allowed
3=acceleration of 12 counts is allowed
4=acceleration of 16 counts is allowed
5=acceleration of 20 counts is allowed
6=acceleration of 24 counts is allowed
7=acceleration of 28 counts is allowed
8=acceleration of 32 counts is allowed
9=acceleration of 36 counts is allowed The full implementation of the gain control or gain reduction algorithm is preferably performed using the following steps:

First, a gain number is calculated based on maximum allowed velocity, maximum allowed acceleration, peak velocity, and peak acceleration of the cable 28. FIG. 4 illustrates a table used to calculate the gain based upon these variables. To calculate a gain number, a first result is calculated by subtracting the absolute value of the peak velocity from the maximum allowed velocity. If the first result is a negative number, the first result is set equal to zero. Similarly a second result is calculated by subtracting the absolute value of the peak acceleration from the maximum allowed acceleration. If the second result is a negative number, the second result is set equal to zero.

A third result is then determined from the table shown in FIG. 4. The maximum allowed velocity and maximum allowed acceleration settings are used to determine or lookup the value of the third result.

The first, second and third results are multiplied together to form a product. The product is equal to approximately 65,535 if both the peak velocity and peak acceleration values are equal to zero. The product is equal to approximately zero if either the peak velocity or peak acceleration is at the maximum allowed value. This product is a number between 0 and 65,535.

Figure 3:
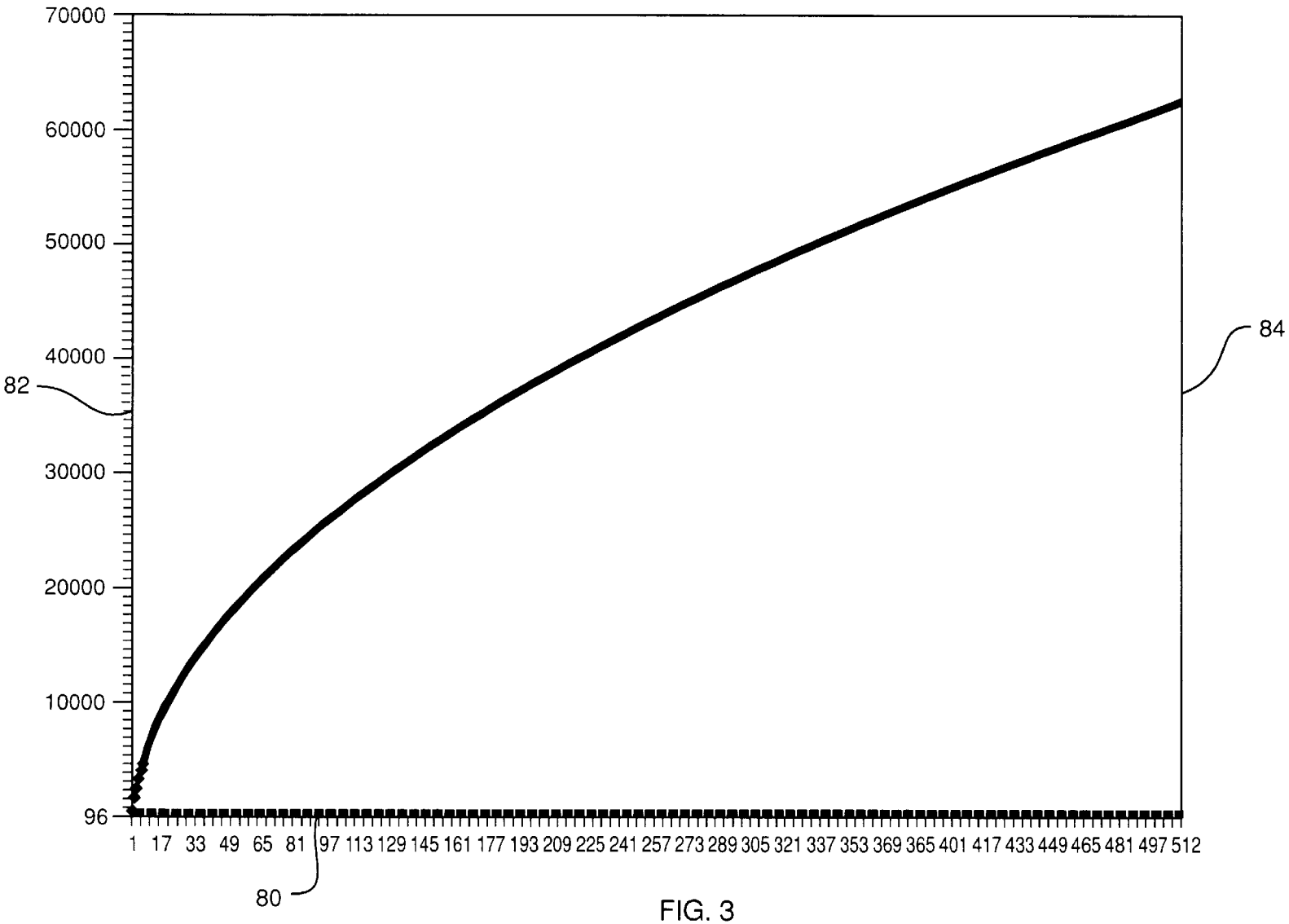
FIG. 3 illustrates a graph of a square root look-up table.

Next, the product described above is divided by the value 128. The result of this division is used as a pointer for the x-axis value in a square root look up table. FIG. 3 illustrates a graph of the square root look up table. The division result is used as the xvalue pointer in the table where the corresponding y-value is determined based on the division result. The table 84 includes both x-values 80 and corresponding y-values 82. The x-values range between 1 and 512. The corresponding y-values range between 96 and 62,736. The y-values are based upon the square root function:

$$y=\mathrm{sqrt}((1024)(1024)(8)(x))-2800$$

X-values between 1 and 512 are placed in the formula and yield corresponding y-values between 96 and 62,736.

The reasoning behind the use of a square root function is shown in FIGS. 2A and 2B. The square root function prevents the variable gain from having a value that is small relative to mid-scale velocity and acceleration values. In FIGS. 2A and 2B the velocity and acceleration numbers are normalized such that the value "1" represents the highest actual velocity, the highest acceleration value, the maximum allowed velocity value and the maximum allowed acceleration.

FIG. 2A shows a table wherein the values within the table are given by the equation:

(1–actual velocity)*(1-actual acceleration)

When the velocity and acceleration are each 0.4 (only 40% of their maximum values) the gain is reduced to 0.36. This gain reduction can be relatively high for velocity and acceleration values that do not approach the maximum allowed values.

FIG. 2B shows a table wherein the values within the table are given by the equation:

sqrt ((1-actual velocity)*(1-actual acceleration))

For example, when the actual velocity and actual acceleration values are equal to 0.4, the gain calculation from the above equation is 0.6. Taking the square root prevents the gain numbers from being reduced by a relatively large amount as the actual velocity and actual acceleration increases.

In the final step of the gain reduction algorithm, the joystick integer value is multiplied by the resulting y-value of the square root function and then divided by the value 262,144. This final result is the gain used to drive the valve 32.

The micro-processor that can be used to implement this algorithm is a 8 bit, 6.144 Mhz Z80180. The microprocessor can be formed as part of the controller 40. The microprocessor has a 8×8 multiply instruction, and allows all three of the aforementioned steps to execute in approximately 2 to 4 msec. Preferably, the algorithm executes once every 6.25 msec.

Figure 5:
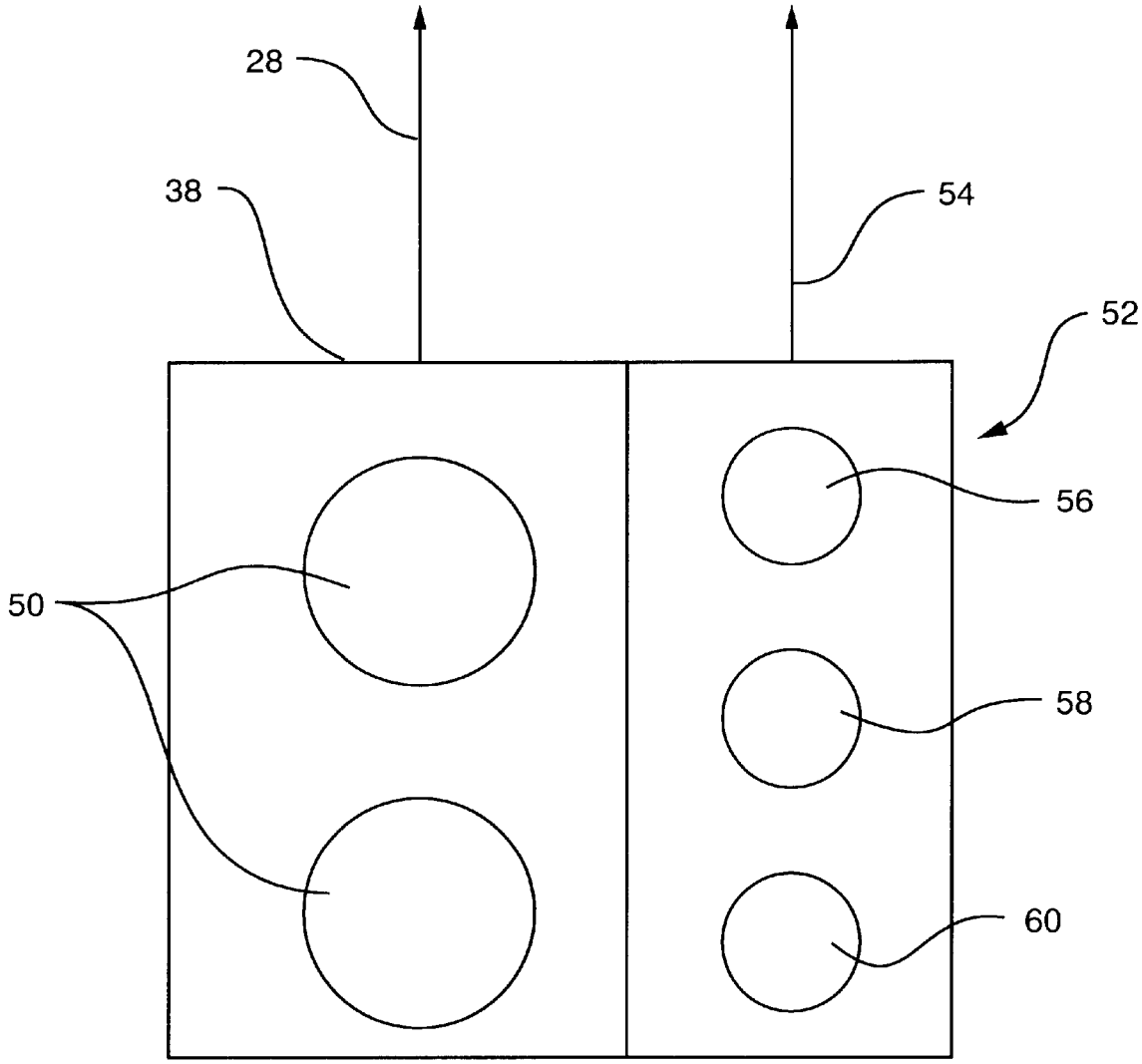
FIG. 5 illustrates a load selection mechanism for the control system.

The actual use of the gain algorithm demonstrates a disadvantage of not using a closed loop control algorithm, which can lead to poor velocity regulation. Given a predetermined maximum allowed velocity acceleration, a light load can still accelerate more quickly than a heavy load. In an alternate embodiment, the control system 10 includes a load selector 52, as shown in FIG. 5. The load selector 52 can be used to aid in the speed regulation of the hoist. The load selector 52 can be located on the actuator 38 as an additional control, as shown, or can be located separately from the actuator 38. The load selector 52 allows a user to select the approximate weight or mass of the load 30 attached to the cable 28. This selection is sent to the control system 40 by a load selection data line 54. The selection implements various maximum velocity or acceleration values for the hoist 15. The load selector 52 can include selections for either light 56, medium 58 and heavy 60 loads or for a light and a heavy load. Such a selection improves speed regulation of the hoist 10 for a wide range of loads. The different selections implement different maximum velocities and accelerations to improve velocity and acceleration regulation over a large range of loads.

When a user is causing the hoist 15 to lift a load, the load lifts because the pressure inside the hoist 15 or balancer is greater than the pressure exerted by the load 30 itself. When the user requests the lifting to stop, the magnitude of the difference between these two pressures can add an overshoot error to the position where the user wants the balancer 15 to stop. A similar problem exists when lowering a load. A method of reducing the overshoot error is to pulse the valve 32 in a direction opposite that of its current motion to reduce the difference between the pressure within the balancer 15, and the pressure of the load 30 suspended by the balancer 15.

Figure 6:
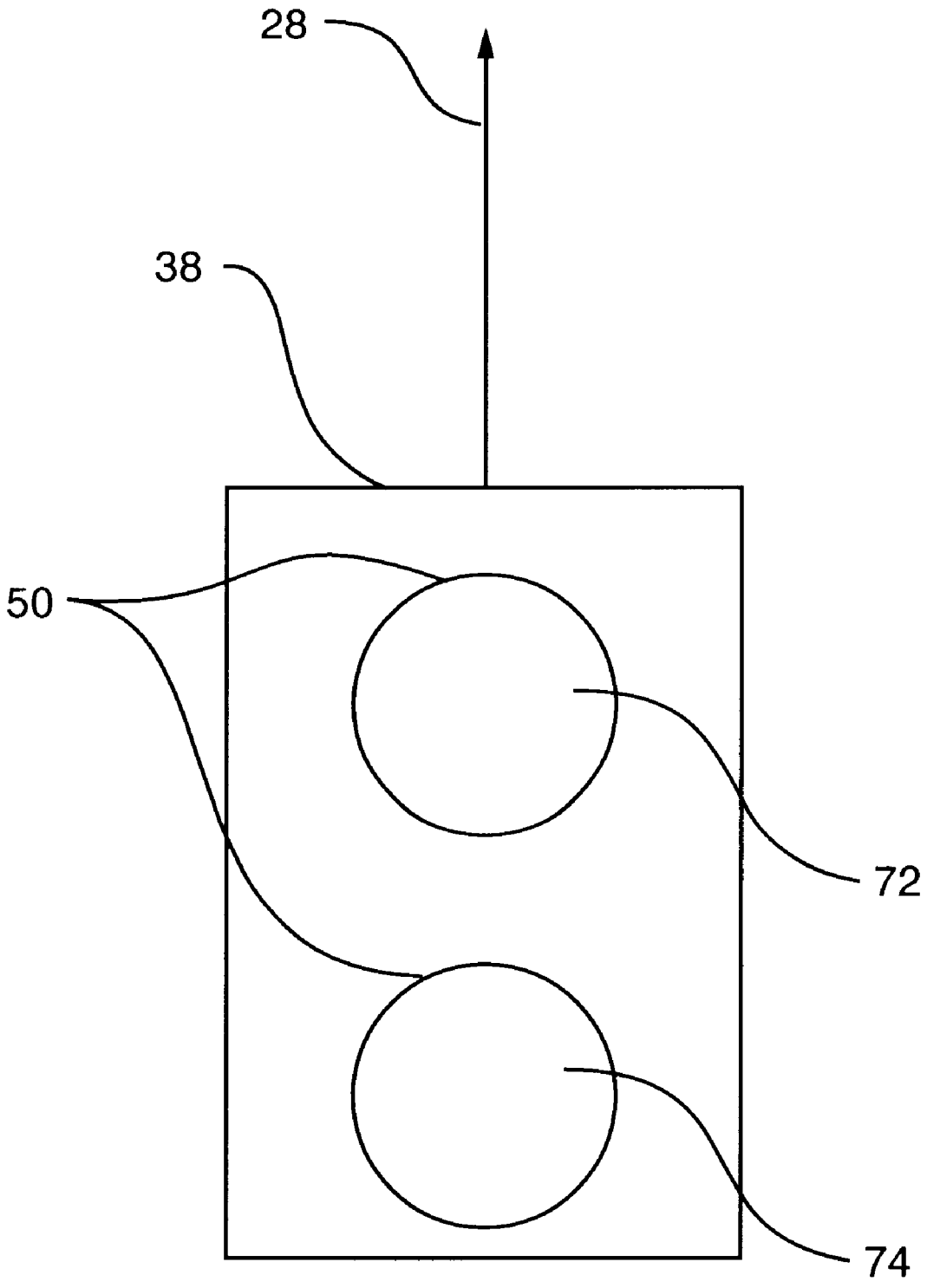
FIG. 6 illustrates actuator controls for the actuator.

To implement this concept, the actuator 38 can also produce a deadband value. As shown in FIG. 6, the actuator controls 50 of the actuator 38 include a first directional or an up control 72 and a second directional or down control 74. The controls 72, 74 produce a voltage in the range of 0V to 5V, for example. The deadband value is equal to the voltage produced when neither control is engaged. For example, when neither control 72, 74 is engaged, a deadband value of 2.5V is produced by the actuator 38. Preferably, the deadband value is within the range of 2.4V and 2.6V, when neither control 72, 74 is engaged. To allow the deadband value to fall within a range of values helps to minimize the potential effect of voltage drift on the voltage produced by the controls. The software for the control system 10 implements an algorithm such that whenever the control input transitions from an up 72 or down 74 control position and into the deadband range, the valve 32 is pulsed in a direction opposite to that of its current motion.

A pulse magnitude algorithm can be used in conjunction with the deadband value to adjust the magnitude and duration of a pulse on the valve. When the user lifts with the balancer 15 at a slow rate, a fixed magnitude pulse on the valve 32 in the opposite direction can be too large and cause the balancer to drop the load some distance because the pressure in the balancer 15 was reduced by a relatively large amount. Preferably, a pulse magnitude algorithm is used to scale a moving average of the valve magnitude as the hoist 15 lifts or lowers. The pulse magnitude is based upon the position of the valve 32 when the actuator controls 50 of the actuator 38 are disengaged and the actuator produces or engages a deadband value. Thus, if a user is lifting a load at a slow rate, the valve 32 is open a relatively small amount. Therefore, a pulse on the valve to a second position in the opposite direction, a second direction, is also relatively small. Conversely, if a user requires a large velocity, the valve 32 is open a relatively large amount. Therefore, a pulse on the valve to a second position in the opposite direction, a second direction, is also relatively large.

As described, the gain reduction algorithm is used as part of an open loop control system. Alternately, the gain reduction algorithm can be used in conjunction with a closed loop control system such as a position or pressure control loop. Once a load 30 has been lifted by the balancer 15, a closed loop control on the balancer's position or on the balancer's pressure can be performed. By implementing a closed loop position control, once the load 30 has been lifted and positioned, the hoist 15 can hold a bucket or barrel of liquid, for example, in a constant location as it is filled or emptied. By implementing a closed loop pressure control, once the load 30 has been lifted, a user can grab and adjust the position of the load 30 by lifting or leaning on the load 30 itself.

The use of a closed loop system with a hoist 15 can create oscillations of the hoist 15 caused by position overshoot of the load 30. The automatic gain reduction algorithm can be utilized in conjunction with the closed loop algorithm to minimize the oscillations created by use of the closed loop control algorithms. For example, a conventional proportional type control algorithms (including PID) can be used in the control system 10. Prior to sending the results of the PID algorithm to the valve 32, the gain reduction algorithm can be implemented. The gain reduction is activated whenever acceleration or velocity approaches a predetermined maximum value. The use of the gain reduction process in conjunction with the proportional control algorithm helps to prevent oscillations of the hoist. If the process does become unstable, the gain reduction algorithm maintains the oscillating process within its maximum allowed velocity and acceleration, resulting in small amplitude, controlled oscillations, rather than large amplitude, uncontrolled oscillations.

While this invention has been particularly shown and described with references to preferred embodiments thereof, it will be understood by those skilled in the art that various changes in form and details may be made therein without departing from the scope of the invention encompassed by the appended claims.

What is claimed is:

1. A hoist comprising:

a housing having a first end wall and a second end wall, the housing, first end wall and second end wall forming a chamber, an inlet mechanism attached to the housing the inlet mechanism allowing the passage of a fluid into the chamber;

a slidable piston mounted within the chamber;

a cable wrapped on the piston for attachment to a load;

a valve connected to the inlet mechanism, the valve controlling the amount of fluid entering the chamber;

a pressure sensor attached to the chamber and in fluid communication with a fluid within the chamber;

a position measuring device connected to the housing and in positional communication with the piston;

an actuator in electrical communication with the valve, the actuator controlling the positioning of the valve; and a control system in electrical communication with the valve, the pressure sensor, the position measuring device and the actuator, the control system having a variable gain between the actuator and the valve, the gain being reduced as the velocity or acceleration of a load attached to the piston approaches a preset maximum value.

2. The hoist of claim 1 wherein the variable gain of the control system comprises a gain reduction algorithm.

3. The hoist of claim 2 wherein the gain reduction algorithm comprises a square root function.

4. The hoist of claim 1 wherein the actuator comprises a plurality of actuator control inputs wherein engagement of an actuator control input pulses the valve in a first direction.

5. The hoist of claim 4 wherein the actuator comprises a deadband value wherein engagement of the deadband value after engagement of an actuator control input pulses the valve in a second direction, opposite to the first direction, thereby stopping the motion of the piston.

6. The hoist of claim 5 wherein the control system comprises a pulse magnitude algorithm wherein the pulse magnitude algorithm scales a moving average of a valve magnitude based upon the first direction of the valve.

7. The hoist of claim 1 wherein the hoist further comprises a load selector wherein the load selector adjusts a maximum allowed velocity value and a maximum allowed acceleration value of the hoist with respect to a load attached to the hoist.

8. The hoist of claim 1 wherein the control system further comprises a closed loop control system.

9. The hoist of claim 8 wherein the closed loop control system comprises a position control.

10. The hoist of claim 8 wherein the closed loop control system comprises a pressure control.

11. A method for adjusting the velocity of a load attached to a pneumatic hoist comprising the steps of:

providing a control system for a pneumatic hoist having a maximum allowed velocity value and a maximum allowed acceleration value for a load attached to the hoist;

measuring a velocity or acceleration of the load attached to the hoist;

comparing the measured velocity or acceleration of the load against the maximum allowed velocity value or maximum allowed acceleration value; and adjusting a gain between an actuator and a valve of the control system in response to the results of the comparison in order to adjust the velocity or acceleration of the load, such that the gain of the control system is reduced as the measured velocity or acceleration of the load approaches the preset maximum allowed velocity value or the maximum allowed acceleration value.

12. The method of claim 11 further comprising the steps of:

providing a load selector attached to the hoist; and selecting a load level on the load selector corresponding to the load attached to the hoist, the load level corresponding to a preset maximum allowed velocity value or a maximum allowed acceleration value.

13. The method of claim 11 comprising the step of using a square root function to reduce the gain of the control system.

14. The method of claim 11 comprising the step of using an updated peak velocity or peak acceleration value of the load attached to the hoist to reduce the gain of the control system.

15. A method for stopping the motion of a load attached to a hoist comprising the steps of:

providing a hoist having a piston, a valve and an actuator, the actuator having a plurality of piston directional control inputs and a deadband input;

engaging a piston directional control input, thereby causing the piston to rotate in a chosen direction and causing the valve to pulse in a first direction;

engaging the deadband input, thereby causing the valve to pulse in a direction opposite to the first direction;

scaling a magnitude of the pulse from the valve to correspond with the velocity of the piston;

reversing the direction of rotation of the piston; and stopping the motion of the load.

16. A method for stopping the motion of a load attached to a hoist comprising the steps of:

providing a hoist having a piston, a valve and an actuator, the actuator having a plurality of piston directional control inputs and a deadband input;

engaging a piston directional control input, thereby causing the piston to rotate in a chosen direction and causing the valve to pulse in a first direction;

engaging the deadband input, thereby causing the valve to pulse in a direction opposite to the first direction;

scaling a duration of the pulse from the valve to correspond to the moving average of a valve magnitude based upon the first direction of the valve;

reversing the direction of rotation of the piston; and stopping the motion of the load.

* * * * *